United States Patent [19]

Sundby

[11] 3,953,380

[45] Apr. 27, 1976

[54] LIQUID DETERGENT

[75] Inventor: Bjorn Sundby, Piscataway, N.J.

[73] Assignee: Colgate-Palmolive Company, New York, N.Y.

[22] Filed: Mar. 30, 1973

[21] Appl. No.: 346,681

Related U.S. Application Data

[63] Continuation of Ser. No. 84,945, Oct. 28, 1970, abandoned.

[52] U.S. Cl. ..... 252/543; 252/89 B; 252/524; 252/527; 252/545; 252/546; 252/548; 252/DIG. 14

[51] Int. Cl.[2] ..... C11D 1/72

[58] Field of Search ..... 252/89, 524, 527, 540, 252/543, 546, 559, 529, DIG. 14, 171, DIG. 1, 548

[56] References Cited

UNITED STATES PATENTS

| | | | |
|---|---|---|---|
| 2,943,058 | 6/1960 | Cook | 252/153 |
| 2,994,665 | 8/1961 | Reich et al. | 252/529 |
| 3,232,880 | 2/1966 | Mausner et al. | 252/548 X |
| 3,265,625 | 8/1966 | Grob | 252/546 |
| 3,355,390 | 11/1967 | Behrens | 252/546 |
| 3,393,154 | 7/1968 | Treitler | 252/546 |

FOREIGN PATENTS OR APPLICATIONS

| | | | |
|---|---|---|---|
| 1,126,479 | 9/1968 | United Kingdom | 252/156 |

OTHER PUBLICATIONS

Pollard, "Amino Acid Chelating Agents in Detergents," Soap and Chemical Specialties (Sept. 1966), pp. 58–62, 130–132.

Stensby, "Optical Brighteners and Their Evaluation," Soap and Chemical Specialties (Apr. 1967) 1967), 41–44, 98–104.

*Primary Examiner*—Herbert B. Guynn
*Attorney, Agent, or Firm*—Richard N. Miller; Murray M. Grill; Herbert S. Sylvester

[57] ABSTRACT

A clear liquid synthetic organic heavy duty laundry detergent composition includes a condensation product of a higher fatty alcohol and polymeric ethylene oxide, fluorescent brightener, water and lower monohydric alcohol. The liquid detergent composition is biodegradable. The substantial proportion of nonionic condensation product detergent present is prevented from gelling by the alcohol and in turn, aids in solubilizing the fluorescent brightener. In preferred compositions, small proportions of sequestering agents e.g., nitrilotriacetate, and salt-forming base, e.g., monoethanolamine, are also present. Surprisingly, cleaning of soiled laundry is comparable to that obtained with the equivalent quantities of phosphate-containing built detergents, even when the present liquid contains much less than a normal building proportion of nitrilotriacetate or other substitute for the phosphate.

8 Claims, No Drawings

LIQUID DETERGENT

This is a continuation of application Ser. No. 84,945, filed Oct. 28, 1970, now abandoned.

SUBJECT OF THE INVENTION

This invention relates to a liquid detergent useful for heavy duty laundering of soiled clothing and other cloth or fabric articles. More particularly, it relates to such compositions which are clear, biodegradable and function comparably to conventionally phosphate-built or nitrilotriacetate-built commercial heavy duty laundry detergent, even in the absence of builders. The invention is also of a process of laundering which may involve the use of such detergent compositions.

BACKGROUND OF THE INVENTION

In recent years there has been a sharply increasing awareness of possible disruptive effects on the ecology attending discharge of various pollutants into ground waters, streams, rivers, and lakes. Particularly undesirable is the large scale discharge of compounds which persist in the environment and adversely affect the qualities of our waters. As a result of government and individual concern, manufactures of detergent compositions are endeavoring to eliminate non-biodegradable synthetic organic detergent materials, e.g., branched chain alkyl benzene sulfonates, as the organic surface active agents in commercially available household laundry detergents. Similarly, at the present time they are engaged in extensive research efforts to replace polyphosphate builder constituents of such compositions so that the wash discharges from household and commercial laundries will not cause possible accumulations of phosphates in rivers and lakes.

Because of the very desirable building, sequestering and soil-suspending activities of the polyphosphates, especially the alkali metal tripolyphosphates and pyrophosphates, it has previously been difficult to eliminate them from detergent compositions without significant losses in cleaning power. Even 100% active synthetic organic detergents have not been able to produce the same cleaning effect as is obtained from combinations of such compounds and polyphosphate(s). At the present time, about the only substitute in part for the polyphosphates which appears to be able to duplicate their effects substantially is nitrilotriacetic acid or a corresponding nitrilotriacetate, which are often referred to as NTA.

DESCRIPTION OF THE INVENTION

The present liquid detergents are based on a simple and commercially obtainable nonionic detergent which is readily biodegradable. They contain no polyphosphates or other inorganic builder salts in substantial amount as a builder and include only a very small proportion of NTA, to act as a sequestrant and prevent discoloration of the products and laundry washed. In the clear liquid product various constituents aid in solubilizing other components so that the product made is a clear and concentrated, yet readily pourable liquid. Repeated test washings indicate that it is equivalent to other commercial built detergent compositions in cleaning action against realistic "body soil" and actual laundering tests in home laundry washing machines and against mixed laundry loads confirm this conclusion.

In accordance with the present invention a liquid detergent composition suitable for laundry used comprises as the major detergent constituent thereof a material (e.g. a condensation product of fatty alcohol and ethylene oxide or polyethylene glycol) having the formula $RO(_2H_4O)_nH$, wherein R is a straight chain alkyl of 10 to 18 carbon atoms and $n$ is from 5 to 14, $n$ being about 0.5 to 1 times the number of carbon atoms in R, a minor proportion of a fluorescent brightener system that is normally at least partially water insoluble, water and lower monohydric alcohol, which is either ethanol or isopropanol, with the proportions of fatty alcohol-ethylene oxide condensation product detergent, fluorescent brightener system, water and alcohol being such that the fatty alcohol-ethylene oxide condensation product solubilizes the insoluble fluorescent brightener in the water-alcohol solvent system. In the preferred embodiments of the invention specific ranges of proportions of the constituents are present and the composition includes a nitrolotriacetic acid sequestrant or salt thereof and an alkaline base, such as monoethanolamine. The invention also relates to washing methods in which such compositions may be utilized.

DETAILED DESCRIPTION OF THE INVENTION

The unique synthetic organic detergent for use in the present concentrated clear and liquid detergent compositions is a nonionic condensation product of fatty alcohol with ethylene oxide or ethylene glycol. Normally the condensation will be with ethylene oxide, which is cheaper and which does not require the removal of byproduct water. Methods for the manufacture of such compounds are well known and these materials have been previously employed in detergent compositions, although generally their use has been limited to being part of the active organic detergent portion of light duty liquids. The nonionics are of the formula $RO(C_2H_4O)_nH$, wherein R is a straight chain alkyl of 10 to 18 carbon atoms and $n$ is from 5 to 14. Generally, due to the method of manufacture, mixed alkyls are employed and the ethylene oxide chains will include different chain lengths within the 5 to 14 ethylene oxide radical range. There is a measure of criticality in having the detergent fatty alkyl and ethylene oxide chain lengths within the ranges given so as to obtain good detersive properties together with desirable solubilities and compatibilities with other detergent compositions ingredients. Generally, the alkyl group will be 11 to 16 carbon atoms and usually the average carbon contents of preferred compounds are 11 or 14 to 15. In the most preferred nonionic detergent compounds the alkyl groups will be essentially, usually over 80%, or 14 to 15 carbon atom chain lengths. Similarly, it is preferable to have from 5 to 6 or 10 12 ethylene oxide radicals per chain and in a most preferred embodiment these will average about and very preferably, be essentially equal to 11 ethylene oxides per chain. Preferred nonionics that are used are Neodol 4511 (R = mixed 14 and 15 carbon atoms alkyls, $n = 11$, average value), made by Shell Chemical Co., and a compound wherein $n = 5$ or 6 and R = 11 (10–12) made by Monsanto Co. The desired hydrophile-lipophile balance is maintained by keeping the $n$ equal to about 0.5 to 1 times R.

In addition to the chain lengths of the hydrophilic and lipophilic portions of the detergent being within the mentioned ranges, for best detergency and biodegradability it is important that such portions be of certain configurations. Of necessity, the ethylene oxide chain will be linear and will be terminated in a free hydroxyl. The alkyl group also most preferably will be linear although a minor degree of slight branching, as at a carbon next to or two carbons removed from the terminal carbon of a straight chain and away from the ethoxy chain may be tolerated, providing that such branching alkyl portion is of no more than three carbon atoms in length. Usually the proportion of carbon atoms in such branching configuration will be very minor, rarely being more than 20 or 10% of the entire alkyl content of carbon atoms.

Although the linear alkyls which are terminally joined to the ethylene oxide chains are highly preferred and result in the best detergency, biodegradability and other important properties of liquid detergents, medial or secondary joinder to the ethylene oxide chain may occur in a minor proportion of such alkyls and generally such proportion will be less than 20% and preferably less than 10% thereof. A further change that is tolerable in such compounds includes the presence of small quantities of propylene oxide, instead of ethylene oxide, but usually the propylene oxide contents will be sufficiently minor so that the hydrophilic chains are essentially of ethylene oxide, generally over 80% and preferably over 90% thereof.

For most of the heavy duty liquid detergents it will be unnecessary and undesirable to utilize active detergent ingredients other than the fatty alcohol-ethylene oxide condensation products described above. Yet, for some applications minor proportions of supplementary detergents may be used. These will generally be of the nonionic type although in some formulations anionic, cationic, amphoteric or ampholytic detergents or surface active agents of known types may be employed. For example, there may be used higher fatty acid esters of polyethylene glycols, straight chain middle alkyl phenyl polyethylene glycols, block copolymers of ethylene oxide and propylene oxide (Pluronics), higher alkyl-di-lower alkyl amine oxides, the sodium salts of the sulfuric acid derivatives of higher fatty alcohol condensation products with ethylene oxide, triethanolamine lauryl sulfate, straight chain alkyl sulfonates, sodium lauroyl sarcoside, cetyl trimethylammonium bromide, benzethonium chloride, dimethyl dibenzyl ammonium chloride, N-higher alkyl N,N-di-lower alkyl aminopropane sulfonates, amidosulfobetaines, betaines and amidobetaines. Descriptions of additional such detergents may be found in the text Synthetic Detergents by Schwartz, Perry and Berch, published in 1958 by Interscience Publishers, New York. See pages 25 to 143. It will be kept in mind that such materials will be employed only for specific purposes and in small proportions, compared to the condensation products of higher fatty alcohol and ethylene oxide and will usually be used when a specific cleaning property thereof is desirable for a particular application.

The fluorescent or optical brighteners or whiteners employed are important constituents of modern detergents which give washed laundry and materials a bright appearance so that the laundry is not only clean but also looks clean. Due to the variety of synthetic fibers incorporated in the textiles which are made into clothing and other items of laundry and the importance of substantivity of the brightener compound to the fibers, many different fluorescent brightening compounds have been made, which may be incorporated in the present detergent compositions, often in mixtures. Of course, brighteners, suitable for use on cotton and brigteners which are stable in the presence of oxidizing bleaches are also of importance. Therefore, although it is possible to utilize only a single brightener for a specific intended purpose, in the compositions of the present invention it is generally important to utilize a mixture of brighteners which will have good brightening effects on cotton, nylons, polyesters and blends of such materials and which, additionally, are bleach stable. A good description of such types of optical brighteners is given in the article, *Optical Brighteners and Their Evaluation*, by Per S. Stensby, a reprint of articles published in *Soap and Chemical Specialties* in April, May July, August and September, 1967, especially at pages 3–5 thereof.

The cotton brighteners, frequently referred to as CC/DAS brighteners because of their derivation from the reaction product of cyanuric chloride and the disodium salt of diaminostilbene disulfonic acid in molar proportion of 1:2 are bistriazinyl derivatives of 4,4′-diaminostilbene-2,2′-disulfonic acid. In most cases, the CC/DAS is reacted with two moles of aniline or sulfanilic or metanilic acid and the product is additionally substituted on the triazine rings. Such compounds are of the general formula:

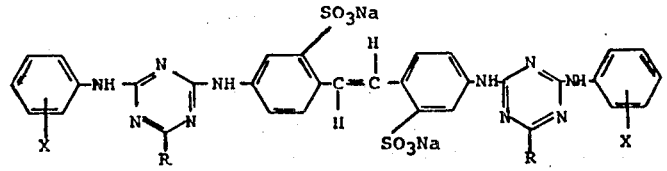

wherein X may be either hydrogen or $SO_3Na$ and the R's may be those derived from aniline, morpholine, N-methylethanolamine or diethanolamine. Because some heavy duty laundry detergents will be employed in conjunction with bleach, a bleach stable brightener, usually a benzidine sulfone disulfonic acid, a nathphotriazolylstilbene sulfonic acid or a benzimidazolyl derivative will be used. These compounds are of the formulas

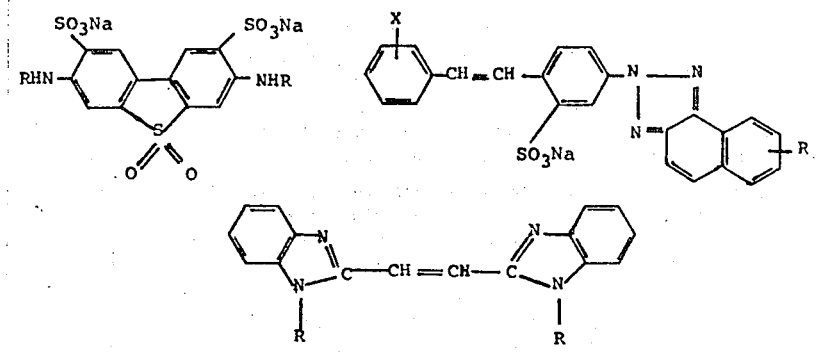

wherein R may be hydrogen, lower alkyl, lower alkanol, lower aminoalkanol, anilino, morpholino, etc. The polyamide brighteners, especially good for nylons, are usually either aminocoumarin or diphenyl pyrazoline derivatives. Unfortunately, neither of these is especially stable in the presence of chlorine bleaches. The compounds are of the formulas given below and the R and the R′ groups thereof may be those previously listed as substituents on the optical brighteners discussed eariler, while X and Y may include such substituents, halogens and lower alkyls.

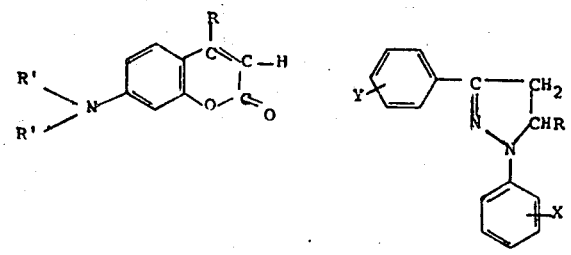

The polyester brighteners, which are becoming of more importance as polyesters are being used to a greater extent in an increasing proportion of textiles are usually of one of the following formulas, wherein R, X and Y have the means previously given and Z may be selected from the group of X and Y substituents. These brighteners also usually serve to whiten polyamides.

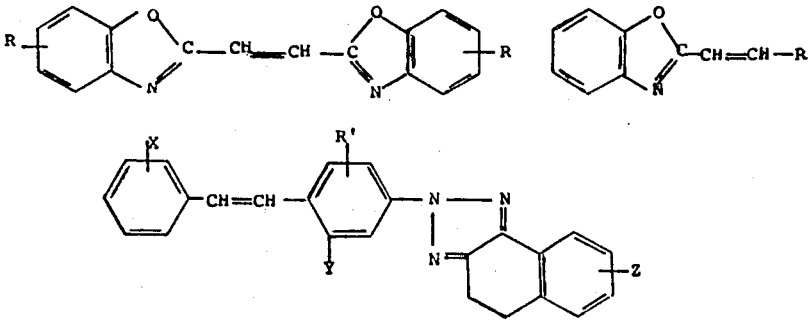

The brighteners are used in their acid forms or as salts. They may be employed as solids or in solutions and may be cut with a carrier powder. Although the chemical and physical forms can affect brightening actions, if the compounds are used in soluble forms brighteners activities for the same compounds on an active ingredient basis will be equivalent. In the present compositions and in the wash waters resulting, the brighteners are maintained sufficiently soluble so as to be effective and uniformly substantive to the materials of the laundry being washed.

Among the brighteners that are used in the present systems are: Calcofluor White ALF (American Cyanamid); ALF-N (American Cyanamid); SOF A-2001 (CIBA); CWD (Hilton-Davis); Phorwite RKH (verona); CSL, powder, acid (American cyanamid); CSL, liquid, monoethanolamine salt (American Cyanamid); FB 766 (Verona); Blancophor PD (GAF); UNPA (Geigy); Tinopal RBS (Geigy); and RBS 200 (Geigy). The acid or "nonionic" forms of the brighteners tend to be solubilized by alcohols of the present formulas, while the salts tend to be water soluble. Thus, a combination of such solvents and the nonionic surface active agents serves to keep the fluorescent brighteners dissolved.

The lower alkanol employed may be either ethanol or isopropanol. Of the two, ethanol is preferred because of a slightly greater solubilizing power and more pleasant odor. If ethanol is used, it will normally be denatured and of the denatured alcohols those identified as SD40 or 3A are preferred. However, other denatured alcohols may also be used. The alcohols need not be anhydrous and the small proportions of water normally present with them are considered to be parts of the water components of the liquid detergents. Some of the alcohol may be replaced with dihydric or trihydric lower alcohols which, in addition to having solubilizing powers and reducing the flash point of the product, also can be anti-freezing constituents and may improve compatibilities of the solvent system with particular product components. Among these compounds, the most preferred group includes the lower polyols of 2 to 3 carbon atoms, e.g., ethylene glycol, propylene glycol and glycerol, but the lower alkyl etheric derivatives of such compounds, sold under the name Cellosolves, may also be employed, generally to only a minor extent.

The water used is preferably deionized so that it will be low content of ions which can form isoluble compounds. However, ordinary tap water can be used providing that the hardness thereof is sufficiently low so that in the formula employed there is no detrimental precipitation out of salts on standing. When sequestrants are present, hardness will be less important and in such cases even waters with hardnesses over 300 parts per million equivalent calcium carbonate can be acceptable. Generally, however, the water hardness should be less than 150 p.p.m. and most preferably, less than 50 p.p.m. The pH, dissolved oxygen or chlorine and chloride contents do not significantly affect the nature of the product made with the water, especially when an alkaline material such as monoethanolamine is also present. However, waters of approximately neutral pH's will generally be preferred and for best appearance of the product the content of dissolved color bodies should be minimal.

The sequestering agent used may be any suitable such compound, including the aminopolycarboxylic acids and hydroxycarboxylic acids. Thus, ethylene diamine tetraacetic acid, nitrilotriacetic acid, hydroxyalkyl derivatives thereof in which the hydroxyalkyl group replaces one or more acetic acid groups, gluconic acid, ascorbic acid, glucono-delta-lactone (which is converted to gluconic acid), citric acid, glucuronic acid, lactic acid and salts thereof, especially those of the water soluble alkali metals, e.g., sodium, potassium, ammonium, alkanolamines and amines may be used. Other sequestering or water-softening agents of the inorganic type such as certain phosphates may be used in very small amount if desired but are not present in amount sufficient to have a builder content.

The alkaline base compound, useful for increasing the alkalinity of the liquid detergent and the pH of wash water in which it is employed, whereby better solubilities of fluorescent brighteners and sequestrants are obtainable, together with improved detergency, may be any of the compatible alkaline materials employed in the detergent art. Normally, however, it will be preferred to utilize lower alkanolamines, lower amines ammonium hydroxide, sodium hydroxide or potassium hydroxide. The alkanolamines may be either mono-, di- or trialkanolamines and the alkanols are usually of 1 to 4 carbon atoms, preferably 2 to 3 carbon atoms. In some instances the corresponding lower alkyl amines may be used instead. Of the various bases mentioned, the monoalkanolamines, especially monoethanolamines, appear to be most satisfactory, best helping to make the various constituents of the liquid detergents compatible and aiding in improving detergency of the product in laundering.

Adjuvants may be present in the liquid detergent to give it additional properties, either functional or aesthetic. Thus, there may be used soil suspending or anti-redeposition agents, e.g., polyvinyl alcohol, sodium carboxymethyl cellulose, hydroxypropylmethyl cellulose, enzymes, e.g., proteases, amylases, thickeners, e.g., gums, alginates, agar agar, hydrotropes, e.g., sodium xylene sulfonate, ammonium benzene sulfonate, foam improvers, e.g., lauric myristic diethanolamide, foam destroyers, e.g., silicones, bactericides, e.g., tetrachlorosalicylanilide, hexachlorophene, fungicides, dyes, pigments (water dispersible), preservatives, ultraviolet absorbers, fabric softeners, pearlescing agents, opacifying agents, e.g., behenic acid, polystyrene suspensions, and perfumes. Of course, such materials will be selected for the properties desired in the finished product and to be compatible with the other constituents thereof.

The pH of the heavy duty liquid detergent composition will normally be on the alkaline side and the presence of the alkalizing agent will be sufficient to maintain the optical brighteners and sequestering agents in their soluble salt forms. A pH reading, using a glass electrode and a reference calomel electrode, indicates a maximum pH of about 14. However, because the system is essentially non-aqueous despite the presence of a minor proportion of water, the pH reading obtained may be false. A better indication of the alkalizing capacity or alkali content of the detergent is obtained by measuring the pH of a 25% solution in water. This should usually be in the range of about 9.5 to 10.5. In water containing items to be laundered the pH will normally be lowered to from 7.4 to 9. In preferred washing operations the pH can be from 8.5 to 9 at the beginning of the washing operation and may be lowered to from 7.4 to 8 at the end.

The proportions of the various components of the present heavy duty liquid detergents are important to the obtention of a uniform product and acceptable heavy duty laundering action. In the absence of a significant builder content, it is very important that the product contain a significant proportion of the fatty alcohol-ethylene oxide condensation product detergent. So as to promote solubility of the fluorescent brighteners and other constituents and make a clear, homogeneous and readily pourable liquid product, from 40 to 75% of the liquid detergent should be fatty alcohol-ethylene oxide condensation product, the formula of which has previously been given. The preferred range is from 45 to 60% and in the most preferred embodiment of the invention about 50% is employed. Strangely enough, this very high concentration still yields a fairly thin liquid product and is compatible with the other constituents so that a clear detergent can be made. For greatest effectiveness, the quantity of supplementary detergent or surface active agent should be held to 20% of the final product and one-half the content of the main detergent condensate.

The concentration of fluorescent or optical brightener or whitening agent in the product will be from about 0.5 to 5% on an active ingredient basis, preferably about 1 to 3% and most preferably about 2%. Such quantities are readily solubilized in the clear liquid product and contribute substantially to brightening of fabrics in the laundry. Generally, at least 25% and preferably at least 50% of the optical brightener content will be a brightener for cotton. It is preferred to use about 51 to 90% of a cotton brightener, with the balance being one or more of polyamide brighteners, polyester brighteners, and chlorine-stable brighteners.

The lower monohydric alcohol will be present in a sufficient proportion to maintain the fatty alcohol-ethylene oxide condensate in a non-gelled state and sufficient alcohol will be present to aid in stabilizing or dissolving various other constituents of the product. The proportion employed will generally be from 5 to 35%, preferably from 5 to 25%. When used without any supplementing diol or triol, the quantity of alcohol present normally is from 20 to 25% but when the supplementing polyol is used the content of alcohol may be reduced to from 5 to 15%, preferably about 10%. In such circumstances, the proportion of polyol will generally be from 5 to 15%, most preferably about 10%. The percentage of water utilized will also generally be from 5 to 35% and a preferred range of proportions is from 5 to 25%, with a most preferred range being from 15 to 20%. Similar considerations prevail in determining the proportion of water to be employed as do in the case of the alcohols.

The non-building proportion of sequestrant used, most preferably NTA in acid form as charged, is from 0.2 to 3%, preferably from 0.5 to 1.5% and most preferably about 0.8%. The alkaline agent, e.g., monoethanolamine, is usually present in a proportion from 0.5 to 8%, preferably from 1 to 5% and most preferably about 3 to 5% of the liquid preparation. Larger quantities of NTA are insoluble or create difficulties with respect to maintaining homogeneity of the product, whereas smaller quantities are ineffective to tie up heavy metal ions, e.g., ferric or cupric ions, in the wash water, which could otherwise cause discoloration of the items washed. With respect to the range of alkaline base compound, greater quantities than 5% can significantly and adversely affect the stability of the liquid product and its functionality as a detergent, whereas less than 0.5% is usually insufficient to satisfactorily neutralize any brightener or sequestrant which may be present in their acidic forms and to impart sufficient basicity to the liquid detergent and the wash water to improve storage stability and detersive properties.

Considering the wide range of adjuvants which may be utilized, for widely different purposes, the quantities or proportions thereof employed will vary. Generally, however, it may be said that the total thereof should not exceed 10% and will preferably be maintained less than 5% and most preferably less than about 3%. Individual components should usually not exceed 5%, preferably 3% and most preferably 1% of the product. The use of more of such compounds will often significantly change the properties of the liquid detergent and therefore, is to be avoided.

The invented heavy duty liquid detergents can be made by simple manufacturing techniques which do not require any complicated equipment or expensive operations. In a typical manufacturing method, the optical brighteners may be slurried in the monohydric alcohol or mixture of monohydric and polyhydric alcohol. If initially slurried in the monohydric alcohol, subsequently the polyhydric alcohol may be added to this. Then water and the amine or other base are added, which help to partially dissolve the previously suspended material but not yield a clear solution. Addition of the fatty alcohol-polyoxyethylene condensate causes the remainder of the brightener to dissolve to make a clear solution. Then nitrilotriacetic acid may be added as the acid or salt (preferably the sodium, potassium or amine salt) and agitation is continued until the solution becomes clarified, which will normally take about 5 to 10 minutes. At this point perfume and dye may be added to give the product its final desired appearance and odor. All of the operations may be effected at room temperature, although suitable temperatures within the range of 10° to 80° C. may be employed, as desired. Additions of adjuvants may be effected at suitable points in the process but for the most part these will be added to the final product. The product obtained will usually have a pH within the range of 9.5 to 10.5, e.g., 10.1 and a density within the range of from 0.9 to 1.1, preferably from 0.95 to 1.05 and most preferably from 0.98 to 1.02. The viscosity of the product at 25° C. will usually be from 20 to 150 centipoises, preferably from 30 to 100 cps., and will be in the higher part of this range if polymeric alcohol is used in replacement of some lower monohydric alcohol.

Use of the present compositions is marvelously simple and efficient. Compared to present heavy duty laundry detergent powders, much smaller volumes of the present liquids may be employed to obtain cleaning of soiled laundry. For example, in a typical and preferred formulation of this invention, containing about 50% of the fatty alcohol-ethylene oxide condensate, only about 2 ounces or one-fourth cup of liquid need to be used for a full automatic machine tub of wash, in which the water volume might be from 15 to 18 gallons. Thus, the concentration of liquid detergent in the wash water is on the order of 0.1%, 1 gram per liter or 1,000 parts per million. Generally, the proportion employed will be from 0.7 to 1.5 grams per liter, which may correspond to 0.3 to 0.6 g./l. of the fatty alcohol-ethylene oxide condensation product, from 0.01 to 0.05 g./l. of the fluorescent or optical brightener, from 0.05 to 0.4 g./l. of lower monohydric alcohol and from 0.005 to 0.03 g./l. of organic sequestrant. The proportions of other constituents of the liquid composition may vary accordingly. Of course, equivalent results can be obtained by using larger proportions of a more dilute liquid detergent but the greater quantity needed will require additional packaging and shipping space and will be less convenient for the consumer to use. However, it is considered that the use of such more dilute products is within the present invention if the relative proportions of components is maintained. In other words, the present invention is not avoided by merely preliminarily diluting the liquid detergent with water since the same end result is obtained because the wash water also serves to dilute the detergent down to a use concentration.

Although it is preferred to employ wash water of reasonable hardness and at an elevated temperature, the present invention is also useful in laundering clothes and other items in hard waters and in extremely soft waters, as well as in waters at room temperature or below. Thus, water hardnesses may range from 0 to over 300 parts per million, as calcium carbonate and washing temperatures may be from 10° to 80° C. Preferably, the temperatures will be from room temperature, 20° to 25° C., to 70° C. Also, although washing will ordinarily be effected in an automatic washing machine, with the washing followed by rinse and spin or other draining or wringing operations, it is contemplated that this detergent may also be used for hand washing of laundry items. In such cases, the concentration in water of the liquid detergent will often be increased and sometimes it may be used full strength to assist in washing out otherwise difficult to remove soils or stains. After completion of the washing and spinning operations, it will be general practice to dry the laundry in an automatic dryer soon thereafter but such particular drying operation is not necessary.

When the liquid detergent is added to water, whether that water is hot or cold, the detergent immediately disperses uniformly throughout the wash water, even in the absence of significant agitation. Washing and brightening agents are carried into contact with all the laundry and there are not localized overconcentrations of either of these materials. The clothing washed, following normal methods, is acceptably clean and in comparative tests the product has been rated as good as some of the best of the commercial heavy duty detergents on the market. Although it is a low- or non-foaming detergent composition and thus very suitable for side-loading washing machines, excellent washing is also obtained in top loading machines in which foaming detergents are normally employed. Repeated testing of soiled and re-soiled laundry items, using the present compositions and larger quantities of commercial heavy duty detergents built with phosphate or NTA, show that the soilings are repeatedly removed and no objectionable buildup thereof occurs. For the most part, users do not note any really significant differences between the washing properties of the present composition and commercial compositions tested. In fact, there has been a significant preference for the present product.

The discovery of the present compositions and their exceptionally good properties was unexpected because those skilled in the art have not expected to be able to make an unbuilt heavy duty laundry detergent composition without the use of inorganic builder salts or EDTA or NTA substitutes for such builders. The present inventor proceeded to explore compositions containing various proportions of NTA and synthetic organic detergents and statistically evaluated the detergencies of the compositions made. From his analysis he noted that the present compositions, unlike all others tested, resulted in good detergency without the use of builders. Furthermore, by statistical evaluation of the experimental results it was determined that the particular fatty alcohol-ethylene oxide condensates were more efficient "builders" for themselves than were larger quantities of NTA. This was expecially surprising in view of the previous use of the present organic detergents only as light duty cleaning agents, since their ability to remove soil from laundry in heavy duty applications was unappreciated. Also, it was a conclusion contrary to that formerly reached by many other research workers in the field of detergency. The use of the condensation products without NTA has no adverse effect on the substantivity of the optical brighteners whereas sequestrants of the NTA or polyphosphate types can interfere with the even deposition of brighteners on laundry. The detergent does not react with hypochlorite bleaches whereas NTA can undergo such reactions. Finally, the various constituents of the detergents, as was previously mentioned, help to mutually solubilize one another and form a flowable clear liquid. The alcohols and water solubilize the brightener system and the detergent condensate aids in producing best solubility and a clear product. The alcohol, optionally with glycol, prevents the liquid detergent from gelling, which is very important. Gel prevention means stain prevention, because otherwise staining of the wash could occur due to deposits of gel holding the brigtener to only some parts of the laundry. This detergent liquid is easily biodegradable and adds no large quantities of phosphate or substitute NTA builder to the wash water. The product is an anti-pollution detergent of surprisingly good activity. Yet, it is available in convenient, attractive form and at a competitive price.

The following examples illustrate the invention but are not to be considered as limiting it. All parts are by weight and all temperatures are in degrees Centigrade.

EXAMPLE 1

| | Percentages |
|---|---|
| $RO(C_2H_4O)_{11}H$(Neodol 45-11, R = mixed 14 and 15 carbon atoms primarily alkyl) | 50.0 |
| SD No. 40 anhydrous alcohol | 22.50 |
| Water, deionized | 15.65 |
| *Optical brightener (a) 23% aqueous solution of monoethanolamine salt | 5.83 |
| *Optical brightener (b) | 0.33 |
| Optical brightener (c) | 0.17 |
| Optical brightener (d) | 0.03 |

-continued

| | Percentages |
|---|---|
| Monoethanolamine | 3.33 |
| Nitrilotriacetic acid | 0.83 |
| Dye, Polar Brilliant Blue, 1% aqueous | 1.00 |
| Perfume | 0.33 |
| | 100.00 |

*Optical brighteners
(a) 4,4'-bis(4-anilino-6-[N-(2-hydroxyethyl)-N-(2-carbamoylethyl)amino]-s-triazin-12-ylamino)-2,2'-stilbenedisulfonic acid
(b) 4,4'-bis[4-anilino-6-di-(2-hydroxyethyl)amino-5-triazin-2-ylamino]-2,2'-stilbene-disulfonic acid
(c) 4-(2H-naphtho[1,2-d]triazolyl)-2-stilbene sulfonic acid
(d) 4-(2H-naphtho[1,2-d]triazolyl)-2-stilbene A mixture of the four optical brighteners, is slurried in the SD No. 40 alcohol, after which water and monoethanolamine are sequentially added with stirring, at room temperature. It is apparent that a portion of the brighteners has dissolved. Subsequently, the Neodol 45-11 is added and after a few minutes of agitation at moderate speed it is noted that the solution is clear. Then the nitrilotriacetic acid is admixed with the clear solution. Initially the solution becomes cloudy but after five or ten minutes agitation it is clarified. Then, the solution and the balance of the composition, including preservative, dye and perfume, are admixed and the solution remains clear. Its density is 0.98 g./ml. and its viscosity is about 40 centipoises at 25° C. The pH of a 25% solution in water is about 9.9. The liquid detergent, a sparkling clear, blue, free-flowing liquid, is then packed in polyethylene plastic bottles of substantially cubic shape and of one quart capacity and is ready for use. Storage tests indicate that the product will be stable for several years without precipitation of insolubles, settling into a plurality of phases or clouding or other disadvantageous effects on appearance or function.

Detergency and brightening power of the liquid detergent composition are evaluated in controlled tests in which the experimental formula is compared with commercial heavy duty laundry detergents. In these tests, cloths are intentionally soiled with dirt from human skin and are washed in identical washing machines (Terg-o-tometer) using the same water and recommended amounts of the experimental and control detergents. The soiling of the cloths is effected by having human subjects periodically rub clean cloths in contact with their facial, neck, arm and hand skin. The soiled cloths are collected and divided so that the experimental and control formulas are used to wash similarly soiled loads of laundry. Such testing is repeated two more times and the whitenesses of the washed cloths are compared each time, by reflectometer.

Using only concentrations that correspond to two ounces of the experimental heavy duty liquid detergent per 16 gallon automatic washing machine tub, the liquid detergent is compared to other washing products in which concentrations are used corresponding to 1¼ cups of a spray dried, heavy duty laundry detergent built with sodium tripolyphosphate. Reflectometer readings of whiteness indicate no significant differences between the detergents. Subjective evaluations of the products in consumer tests, wherein a panel of housewives uses these materials in family washes, result in a significant preference for the liquid.

When the liquid detergent is utilized with hypochlorite bleach, a faint ammonia odor is apparent but is not considered to be objectionable. Otherwise, the "experimentally" washed and bleached clothing and cloths are as good in appearance, whiteness and brightness as the control materials washed with the commercial heavy duty laundry detergent.

In the absence of inorganic polyphosphate builder it has been theorized and some wash tests indicate that particulate soil could accumulate on washed items, after multiple washings. A panel test in which materials are repeatedly laundered indicates no confirmation of the theory and apparently consumers see little significant difference between the experimental and their usual washday products, with respect to removal of particulate soil.

From the above testings, it is apparent that the experimental formula, without inorganic builder and with little NTA, is a surprisingly effective heavy duty laundry detergent, even when employed in very small quantities.

Formulas similar to that given above, in which the alcohol is replaced by isopropanol or in which approximately half the alcoholic content is replaced by propylene glycol, to lower the flash point, yield similar favorable results. Also, when the fatty alcohol-polyoxyethylene condensation product is changed, so that the alkyl group is of 10, 12 or 16 carbon atoms or a mixture thereof and the polyoxyethylene chain is of 8, 10 or 14 ethylene oxide groups or a mixture thereof, similarly effective detergency is obtained. Such is also the case when different optical brighteners are employed and when sodium hydroxide, potassium hydroxide, triethanolamine or ammonia is utilized instead of monoethanolamine as an alkaline material. When the content of nitrilotriacetic acid is replaced by the corresponding trisodium salt, the tripotassium salt or the triethanolamine salt, with the proportion of alkalizing agent present being decreased, similarly effective clear liquid detergents are obtained. Such products also remain clear on storage despite the presence of small quantities of metal ions which can form insoluble salts. Also, no discoloration is noted in clothing washed with such products even when ordinary tap water is used for such washing and when it contains as much as 150 parts per million of hardness, as calcium carbonate, and includes iron.

When the proportions of the various components are changed, within the ranges recited, an acceptable clear liquid product is obtainable and this is also the case when selected adjuvants of the type described are employed in small quantities for their desired effects. When it is wanted to make the product opaque, creamy or cloudy, usually for marketing purposes, an opacifier such as behenic acid results in a uniformly cloudy product, when employed at about 1% concentration. Although clear and stable liquid detergent solutions are obtainable, care should be exercised in formulation. For example, if an excessive quantity of an anionic detergent, e.g., over 7% of lauryl alcohol sulfate is utilized, separation of the product into two phases may occur. Similarly, if the content of ethanol or isopropanol is diminished below 5%, the fatty alcohol-ethylene oxide condensate will often gel. Of course, an experienced formulator of detergent compositions, with the present description before him, will be able to avoid any such adverse effects.

EXAMPLE 2

A series of liquid detergent compositions of the basic formula of Example 1 is made, in which the proportions of Neodol 45-11 and nitrilotriacetate are varied. Detergency is evaluated for such compositions at ratios of nitrilotriacetate to condensation product of about 1:50, 1:10, 1:5, 1:3, 1:2, 1:1, 2:1, 3:1, 5:1, 10:1 and 50:1 Although the nitrilotriacetates employed are in water soluble form as their sodium salts, they are not sufficiently soluble in some compositions to make them clear liquid detergents. However, the materials are nevertheless tested for detergency and it is found, surprisingly, that the use of large quantities of NTA does not improve detergency as much as the additions of smaller amounts of the fatty alcohol-ethylene oxide condensate. It is concluded from these tests that the greatest detergency improvement results when NTA is virtually eliminated as a builder and the condensate is employed instead.

EXAMPLE 3

| | Percentages |
|---|---|
| Neodol 4511 | 65.0 |
| Monoethanolamine | 5.0 |
| *Optical brightener (e) | 3.5 |
| Optical brightener (c) above | 0.4 |
| *Optical brightener (f) | 0.1 |
| Dye solution | 1.0 |
| Perfume | 0.3 |
| Ethanol | 15.0 |
| Deionized Water | q.s. |
| Nitrilotriacetic acid | 0.5 |
| | 100.0 |

*Optical brightener:
(e) 4,4'-bis[4-anilino-6-methylamino-5-triazin-2-ylamino]-2,2'-stilbenedisulfonic acid.
(f) 2-styryl-naphth[1,2-d]oxazole.

Clothes washed in an automatic washing machine of either the top or front loading type, using the product of this or the preceding or following examples, are satisfactorily clean and sweet-smelling. Such washing is at 1 g./l. of liquid detergent composition, a temperature of 70° C., a pH of 8.5 and takes from 20 minutes to 45 minutes, depending on the material washed. The laundry is water rinsed and dried after completion of washing.

EXAMPLE 4

| | Percentages |
|---|---|
| Neodol 45-11 | 40.0 |
| Monoethanolamine or Diethanolamine | 1.0 |
| Brightener System of Example 3, with monoethanolamine salt of brightener (e) instead of acid form | 4.0 |
| Dye Solution (aqueous) | 0.5 |
| Perfume | 1.3 |
| Ethanol | 30.0 |
| Sodium NTA (complete salt) | 2,0 |
| Water, deionized | q.s. |
| | 100.0 |

EXAMPLE 5

| | Percentages |
|---|---|
| Neodol 45-11 | 50.0 |
| Monoethanolamine | 5.0 |
| Optical brightener (e) above | 1.7 |
| Optical brightener (c) above | 0.17 |
| Optical brightener (d) above | 0.03 |
| Ethanol | 11.0 |
| Propylene Glycol | 11.5 |
| Aqueous Dye solution | 0.5 |
| NTA Acid | 0.8 |
| Perfume | 0.3 |

-continued

| | Percentages |
|---|---|
| Softened Water, deionized | 19.0 |
| | 100.0 |

EXAMPLES 6 and 7

The compositions of Examples 1 and 5 are made with the Neodol 45-11 replaced by another nonionic fatty alcohol-polyoxyethylene condensate, the condensation product of from 5 to 6 moles of ethylene oxide, with a fatty alcohol of 10 to 12 carbon atoms, usually about 11 carbon atoms. The products of Examples 1, 5, 6 and 7 are compared by washing soiled cloths three times (with repeated soilings with human skin soil between washings) and comparing whitenesses with each other and a control heavy duty phosphate-built commercial laundry detergent. All clean equally well. All the products are clear liquids and are stable. The compositions of Examples 5 and 7 are of slightly higher densities and viscosities but are also of higher flash points.

In various other washing tests the products of all the aforementioned Examples clean soiled laundry well and find acceptance by consumers. Of course, there are differences in cleaning power, which appear to depend, as would be expected, on the active detergent ingredient content but all the compositions are good liquid products and clean well. Substitutions of other sequestrants and alkaline materials may be effected without loss of properties. For example, in the formula of Examples 6 and 7 KOH may be used instead of the amine and sodium gluconate may be a replacement for the NTA. Similarly, proportions may be varied within the limits of the disclosure and good products are obtained.

The invention has been described with respect to illustrative disclosures and examples but is not to be limited thereto, since the substitution of equivalents for elements thereof is within the spirit of the invention.

What is claimed is:

1. A clear, concentrated liquid detergent composition suitable for laundry use containing no more than 7% by weight of anionic detergent and being free from inorganic and organic builder salts except in sequestering amounts of up to 3% by weight which consists essentially of by weight from 40 to 75% of a nonionic detergent having the formula $RO(C_2H_4O)_nH$, wherein R is a straight chain alkyl of 10 to 18 carbon atoms and *n* is from 5 to 14, said *n* being about 0.5 to 1 times the number of carbon atoms in R, (B) 0.5 to 5% of a normally partially water-insoluble fluorescent brightener, (C) 5 to 35% of water, and (D) 5 to 35% of ethanol or isopropanol, with the proportions of (A), (B), (C) and (D) being such that the alkanol-ethylene oxide condensation product solubilizes the fluorescent brightener in the water-alcohol solvent system.

2. A liquid detergent composition according to claim 1 wherein a mixture of fluorescent brighteners for cotton is present, including at least one cotton brightener which is a bistriazinyl derivative of 4,4′-diamino stilbene-2,2′-disulfonic acid.

3. A liquid detergent composition according to claim 1 wherein (A) is present in an amount of from 45 to 60%, R is of 14 to 15 carbon atoms and *n* is from 10 to 12, said fluorescent brightener is selected from the group consisting of bistriazinyl derivatives of 4,4′-diaminostilbene-2,2′sulfonic acid, benzidine sulfone disulfonic acid, naphthotriazolylstilbene sulfonic acid, benzimidazolyl derivatives, amino coumarins, pyrazolines, naphthotriazdyl derivatives and mixtures thereof, said alcohol (D) is present in amounts of 5 to 25%, said water is present in amounts of from 5 to 25%, said composition further containing at least 0.2% by weight of nitrilotriacetic acid sequestrant or salt thereof and 0.5 to 8% by weight of an alkaline base which increases the pH of the wash water and aids in solubilizing acid forms of the fluorescent brightener and sequestrant.

4. A liquid detergent composition according to claim 1 wherein said brightener (B) is a mixture of a. 4,4′-bis(4-anilino-6-[N-(2-hydroxyethyl)-N-(2-carbamoylethyl)amino]-S-triazin-2-ylamino)-2,2′-stilbenedisulfonic acid monoethanolamine salt, b. 4,4′-bis[4-anilino-6-di-(2-hydroxyethyl)amino-5-triazin-2-ylamino]-2,2′-stilbene-disulfonic acid, c. 4-(2H-naphtho]1,2-d]triazolyl)-2-stilbene sulfonic acid, and d. 4-(2H-naphtho[1,2-d]triazolyl-2-stilbene.

5. A liquid detergent composition according to claim 1 wherein there is present from 5 to 15% by weight of a lower alkylene glycol, the specific gravity is from 0.95 to 1.05 and the pH of a 25% solution in water is from 9.5 to 10.5.

6. A liquid detergent composition according to claim 5 consisting essentially of about 50% of (A) wherein *n* is about 5 to 6, R is undecyl and at least 80% of the undecyl groups present are terminally joined to the ethoxy chains, about 2% of (B), about 11% of of ethanol, about 11% of propylene glycol, about 0.8% of nitrilotriacetate sequestrant and about 5% of monoethanolamine.

7. A liquid detergent composition according to claim 5 consisting essentially of about 50% of (A) wherein *n* is about 11, R is a mixture of 14 and 15 carbon atom linear alkyls, and at least 80% of the R groups are terminally joined to the ethoxy chains, about 2% of (B), about 11% of said alcohol (D), about 11% of propylene glycol, about 0.8% of nitrilotriacetate sequestrant and about 4% of monoethanolamine.

8. A method of laundering soiled clothing with a phosphate-free, biodegradable detergent composition with comprises contacting material to be laundered with an aqueous solution of liquid detergent composition of claim 1 at a concentration of 0.5 to 2 grams of the liquid detergent composition per liter of water at a temperature from 10° to 80° C. and a pH from 7.4 to 9 for from 3 minutes to one hour, rinsing the laundry with water and drying it.

* * * * *